US005682689A

United States Patent [19]

Walker et al.

[11] Patent Number: 5,682,689

[45] Date of Patent: Nov. 4, 1997

[54] ROTATING CLEATS FOR ATHLETIC SHOES

[75] Inventors: Andrew S. Walker, 815 Southfield Rd., Birmingham, Mich. 48009; Elwyn R. Gooding, Ann Arbor, Mich.

[73] Assignee: Andrew S. Walker, Birmingham, Mich.

[21] Appl. No.: 370,345

[22] Filed: Jan. 9, 1995

Related U.S. Application Data

[63] Continuation of Ser. No. 100,758, Aug. 2, 1993, abandoned.

[51] Int. Cl.[6] ..... A43B 5/00; A43B 5/12

[52] U.S. Cl. ..... 36/134; 36/8.3

[58] Field of Search ..... 36/134, 129, 128, 36/59 R, 8.3, 114, 61; 482/146, 147

[56] References Cited

U.S. PATENT DOCUMENTS

| | | | |
|---|---|---|---|
| 2,109,712 | 3/1938 | Schmalz | 36/8.3 |
| 2,671,971 | 3/1954 | Garretson | 36/8.3 |
| 3,025,116 | 3/1962 | McMahan, Jr. | 482/147 |
| 3,091,043 | 5/1963 | McCorkle | 36/8.3 |
| 3,204,348 | 9/1965 | Latson | 36/8.3 |
| 3,354,561 | 11/1967 | Cameron . | |
| 3,680,231 | 8/1972 | Dymond . | |
| 3,707,047 | 12/1972 | Nedwick . | |
| 3,739,497 | 6/1973 | Cameron . | |
| 3,744,160 | 7/1973 | Dymond . | |
| 3,757,437 | 9/1973 | Cameron . | |
| 3,816,945 | 6/1974 | Egtvedt . | |
| 4,687,198 | 8/1987 | Smith | 482/147 |
| 5,392,537 | 2/1995 | Goldberg | 36/134 |

*Primary Examiner*—B. Dayoan

*Attorney, Agent, or Firm*—Brooks & Kushman

[57] ABSTRACT

A shoe having a selectively rotating cleat assembly mounted to the sole of the shoe below the ball of a wearer's foot. The rotating cleat assembly includes a core that mates with and is held in rotatable engagement by a recess in the sole of the shoe. The rotating cleat assembly is free to rotate relative to the sole when the force of impact with a playing surface is substantially normal to a central rotation axis of the cleat assembly. The rotating cleat assembly locks relative to the sole of the shoe when the force of impact with a playing surface is a predetermined angle from the central rotation axis for a given force.

4 Claims, 5 Drawing Sheets

ROTATING CLEATS FOR ATHLETIC SHOES

This is a continuation of application Ser. No. 08/100,758 filed on Aug. 2, 1993 now abandoned.

TECHNICAL FIELD

This invention relates to cleated footwear and more particularly to rotating cleat assemblies on the sole of an athletic shoe.

BACKGROUND ART

Rotating sole plates, i.e. rotatable cleats, for athletic footwear have been known for many years. The rotation is intended to allow the wearer to avoid being anchored rotationally by traditional fixed cleats when the cleats grip a playing surface. When the foot is so anchored, the wearer's foot cannot rotate along with the leg and potentially injurious torsional forces can be produced.

Ankle and knee injuries commonly result from this problem with conventional fixed cleats. The rotating action is significant because many ligament injuries occur while a wearer is running, even without contact from another player. The wearer simply lands flush on a foot and traditional fixed cleats grip the ground, holding the foot in the direction of the initial movement. The wearer's momentum or a quick turn can twist the wearer's femur on top of the knee. This twisting can cause the anterior cruciate ligament (ACL) in the knee joint to be seriously injured. The twisting action of a rotating sole plate, on the other hand, allows the foot to turn relative to the planted cleats and thereby minimizes the possibility of injury.

Cleated rotating sole plates are disclosed in several patents, including U.S. Pat. Nos. 3,354,561 to Cameron, 3,680,231 to Dymond, 3,707,047 to Nedwick, 3,744,160 to Dymond, 3,757,437 to Cameron, and 3,816,945 to Egtvedt.

These patents all disclose cleated rotating sole plates that allow for relatively free rotation of the sole of the shoe relative to the plate whenever the wearer plants a foot on the underlying playing surface. With these free rotation designs, if the rotating sole plate does not impact the underlying surface flush with substantially all cleats impacting the surface simultaneously, there is a danger that the rotating sole plate will pivot around the point fixed by the impacting cleats. This pivot provides an unstable traction for the wearer. The instability is particularly dangerous if the wearer is making sharp cuts or turns while running at high speeds because of the torsional forces generated that can result in serious injury. Thus, the existing rotating cleats are potentially dangerous because if the wearer catches only one or two cleats, i.e., does not plant flush on the rotating sole plate, the shoe may pivot on the planted cleats causing instability and other injury.

DISCLOSURE OF INVENTION

The present invention overcomes deficiencies of existing cleated rotating sole plates by providing a mechanism that allows relatively free rotation of the rotating cleat assembly when it is subjected to a force substantially normal to the playing surface, i.e., when all cleats are likely to impact the playing surface simultaneously in a safe flush planted position, and yet prevents rotation of the rotating cleat assembly, by locking the rotating cleat assembly relative to the sole, when it is subjected to forces from the playing surface that are not substantially normal to the playing surface.

The present invention comprises a rotating cleat assembly including close tolerance mating surfaces between the sole of the shoe and the cleat assembly, preferably with at least one annular recess or protrusion spaced from a central rotational axis located generally below the location of the ball of a wearer's foot. A corresponding protrusion or recess, as the case may be, in the sole of the shoe mates with but does not contact the recess or protrusion, respectively, of the rotating cleat assembly in the un-stressed state. The sole of the shoe also has a central cylindrical cavity centered about the central rotational axis that receives a bearing member of the rotating cleat assembly.

When the wearer is exerting a downward force normal to a playing surface, i.e., substantially parallel to a central rotational axis, the mating surfaces of the annular recesses and protrusions are still held slightly apart due to the impact of the central cavity and the bearing member. When, however, the force exerted by the wearer on the playing surface is not substantially normal, i.e., not substantially parallel to the central rotational axis, the mating surfaces of the sole and the rotating cleat assembly mate with each other. This mating causes the surfaces to contact, which causes a locking or braking action that prevents relative rotation between the sole and the rotating cleat assembly.

It is an object of the present invention to provide an athletic shoe having an improved rotating cleat assembly and mechanism that allows free rotation during certain force or pressure conditions and is locked at other force or pressure conditions.

Still another object of the present invention is to provide a rotating cleat assembly having a rotating locking mechanism and a lubrication mechanism between the rotating cleat and the sole.

A further object of the present invention is to provide a rotating cleat assembly having a rotation locking mechanism and a mechanism for preventing rotation under all conditions.

An additional object of the present invention is to provide a shoe having a rotating cleat assembly including a selectively lockable rotation mechanism that includes an interchangeable member for selectively locking the rotation at differing load conditions based upon the shape and hardness of the interchangeable member.

The foregoing and other objects, features and advantages of the present invention are readily apparent from the following detailed description of the best mode for carrying out the invention when taken in connection with the accompanying drawings.

BEST MODES FOR CARRYING OUT THE INVENTION

Figure 1:
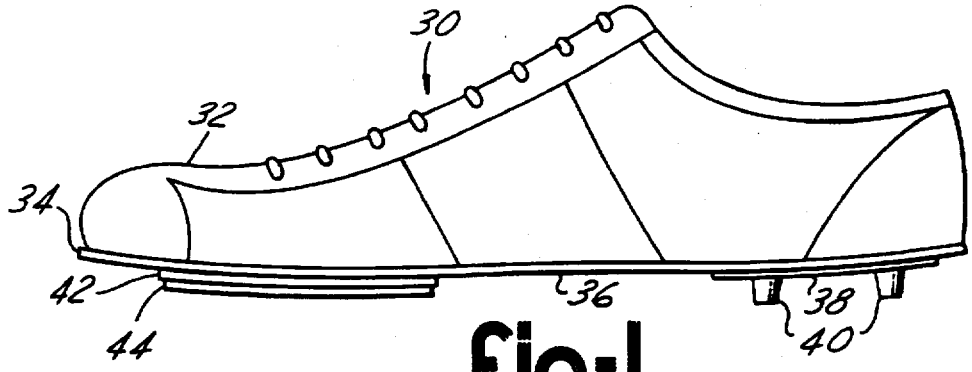
FIG. 1 is a side elevation view of an athletic shoe with a rotating cleat assembly in accordance with the present invention.
Figure 2:
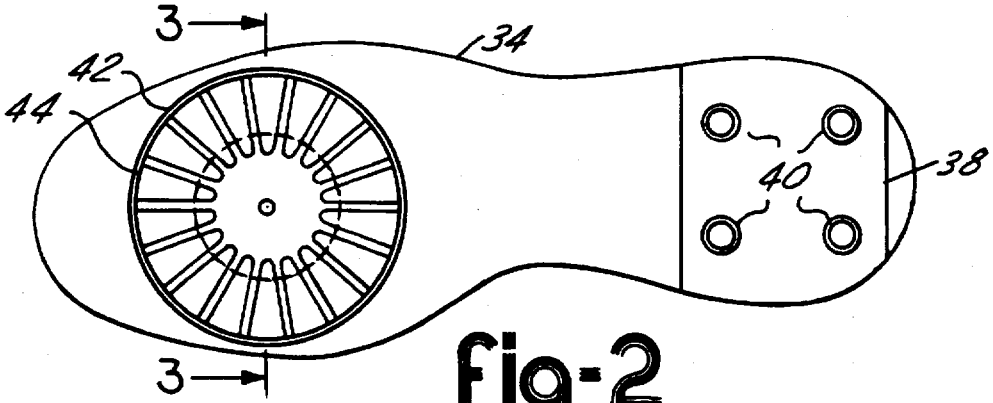
FIG. 2 is a bottom plan view of the shoe and rotating cleat assembly in accordance with the present invention.

FIG. 1 illustrates an athletic shoe 30 having an upper body 32 and a sole 34. Attached to the bottom 36 of the sole 34 is a heel 38. The heel may or may not have cleats 40 attached to its bottom. The sole has an annular recess, discussed below, that contains a rotating cleat assembly 42. On the bottom of the cleat assembly 42 is a protruding cleat pattern 44 that is adapted to embed into or provide traction against a playing surface, whether it is a natural grass surface, a court surface, or artificial turf. The protruding cleat pattern 44 can have many different shapes, arrangements and heights of cleats protruding from its bottom surface, including small traditional shaped cleats, if so desired.

FIGS. 1 to 4 further illustrate the rotating cleat assembly 42 of the present invention. The sole 34 of the shoe 30 is provided with a cavity 46 in the bottom of the sole 36. The cavity 46 is centered about a central rotational axis 48, which is located to align with the ball of the foot of a wearer. The cavity 46 has a central portion 50 that is substantially flat and circular, centered about the central rotational axis 48. Preferably the center portion 50 is greater than 50% of the width of the shoe 30. The bottom surface 68 of the central portion 50 is oriented to be substantially parallel with the playing surface when the shoe 30 is resting on the playing surface. The cavity 46 also has an outer portion 52 that includes a series of concentric annular protrusions 54 and annular recesses 56; the protrusions 54 and recesses 56 are centered about the central rotation axis 48.

The cleat assembly is made up of a bearing member 60 that is circular and 0.0005 inches less in diameter than the central portion 50 of the cavity 46. The central portion 50 has a lip 62 protruding about its perimeter just above its bottom, and the bearing member 60 has a corresponding lip 64 protruding about its perimeter just below its top. These lips 62, 64 interfere with one another such that when the bearing member 60 is inserted into the central portion 50, the lips 62, 64 will snap past each other and will secure the bearing member 60 in place while still allowing rotation between the two. The lips 62, 64 are spaced such that when the bearing member 60 is in the central portion 50, the top surface 66 of the bearing member 60 will be located approximately a minimum of 0.0005 inches from the bottom surface 68 of the central portion 50, thereby forming a gap 58.

Provided in the center of the bearing member 60 is a lubrication bore 70. The lubrication bore 70 can be filled with grease or other types of appropriate petroleum based lubricants to provide lubrication in the gap 58 between the top surface 66 of the bearing member 60 and the bottom surface 68 of the central portion 50. This lubrication bore 70 may be eliminated from the design if so desired, although the preferred embodiment includes this bore 70.

Bonded to and concentric about the bearing member 60 of the rotating cleat assembly 42 is a braking member 72. The braking member 72 includes a series of annular protrusions 74 and annular recesses 76. The annular protrusions 74 mate with corresponding annular recesses 56 of the sole 34, and the annular recesses 76 mate with corresponding annular protrusions 54 of the sole 34. The braking member 72 is located relative to the bearing member 60 so that when the bearing member 60 is inserted into the central portion 50, the corresponding annular protrusions and recesses will have a minimum of approximately 0.0005 inches clearance between the mating surfaces, forming a gap 59. The gap 59 being in a preferable range of 0.0005 to 0.001 inches wide.

Bonded to the bottom surface 78 of the bearing member 60 is a ground impact member 84, which is circular and covers the entire width of the rotating cleat assembly 42. Located in the center of the ground impact member 84 is a bore 80 aligned with the lubrication bore 70 in the bearing member 60. Press fit within the bore 80 is a plug 82 that can be removed to add additional lubrication when needed. Bonded between the ground impact member 84 and the braking member 72 is an inner cushion member 86. The inner cushion member 86, while optional, is preferably included to provide more cushion to the rotating cleat assembly 42 by making the cushion member 86 out of a relatively soft material.

There is a coating bonded on the bottom face 68 of the central portion 50 and on the bottom surface of the annular protrusions 54 and recesses 56. This coating is in the range of 1/16" to 3/32" thick, preferably approximately 0.08 inches. The top surface 66 of the core 60 and the annular protrusions 74 and recesses 76 are also covered with a similar coating. The coating is a very high hardness polyurethane, approximately 80–90 shore D durometer, to allow the mating surfaces of the rotating cleat assembly 42 to rotate within 0.001 inches of the coated surface on the sole 34 without engaging or locking up between one another. The coating is preferably bonded to the surfaces, but could also be accomplished by using material on the surface of the parts that is high enough durometer to hold the gaps 58, 59 without locking up. All durometer hardness measurements used herein are shore D hardness unless otherwise specified.

The preferable material for the ground impact member 84 is polycarbonate for grass playing surfaces, or 40–50 durometer polyurethane for wood or artificial turf playing surfaces. Hard court shoes will have the softer material for impacting the playing surface, and a pattern of cleat such as the triangle pattern shown in FIG. 2. The intermediate layer is of a soft hardness, preferably an elastomeric material, such as rubber, between 20 and 30 durometer shore D. The outer core 72 is preferably a 75 durometer hardness polyurethane and the bearing member 60 is preferably made of an even harder polyurethane. The sole 34 need not be of a particular hardness so long as it is coated as noted above.

The ground impact member 84 material hardness chosen can be customized to the individual height, weight, proficiency and medical requirements of each athlete to adjust under what conditions the rotating cleat assembly 42 locks up. The width of the gaps 58, 59 can also be changed to account for these factors. Further, these ground impacting materials may be interchanged allowing the use of the shoe 30 on different surfaces, as discussed below.

Figure 3:
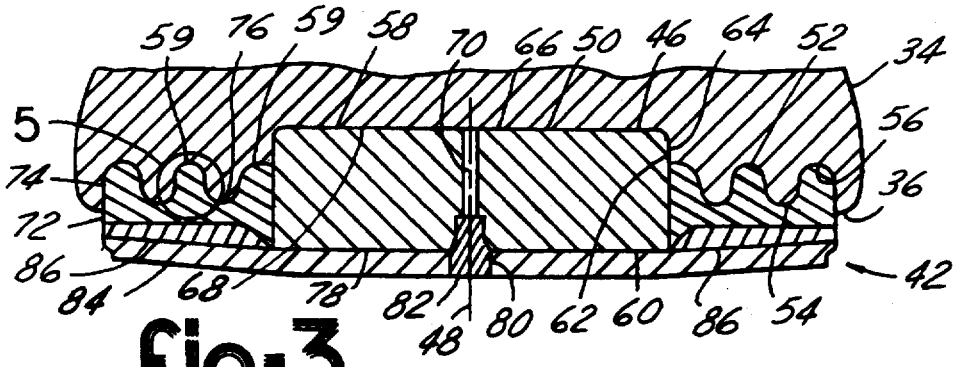
FIG. 3 is a partial cross-sectional view, on an enlarged scale, taken along line 3—3 in FIG. 2.

During athletic play, if the wearer's weight is substantially directly over the shoe 30, i.e., the wearer's weight creates a force that is exerted substantially normal to the playing surfacelike force A shown in FIG. 3, which is substantially parallel to the central rotational axis 48, the top surface 66 of the bearing member 60 contacts the bottom surface 68 of the central portion 50 of the cavity 46, thus eliminating the gap 58 between the two. Since both sides have a hard coating in addition to the lubrication, the two can still rotate relative to one another.

Figure 5:
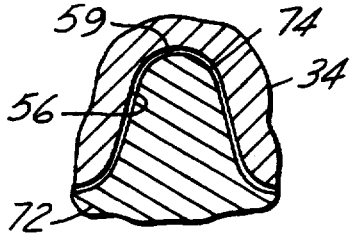
FIG. 5 is an enlarged view taken from the encircled area 5 in FIG. 3.
Figure 6:
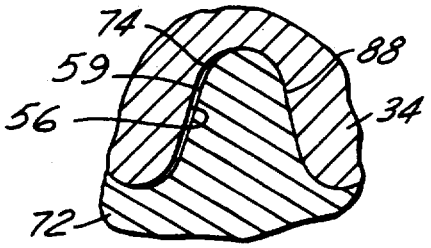
FIG. 6 is an enlarged view taken from the encircled area 6 in FIG. 4.

However, while the force is substantially normal to the playing surface, i.e., the corresponding mating annular protrusions and recesses on the sole 34 and the rotating cleat assembly 42 still maintain their gap 59 and thus do not make surface contact, as shown in FIG. 5. This is possible because the cleat assembly 42 acts like a shoulder screw and the impact is not born by the braking member 72. The rotating cleat assembly 42, therefore, can still rotate in the direction the wearer does and thus reduces the chance of injury from twisted knees and ankles.

Figure 4:
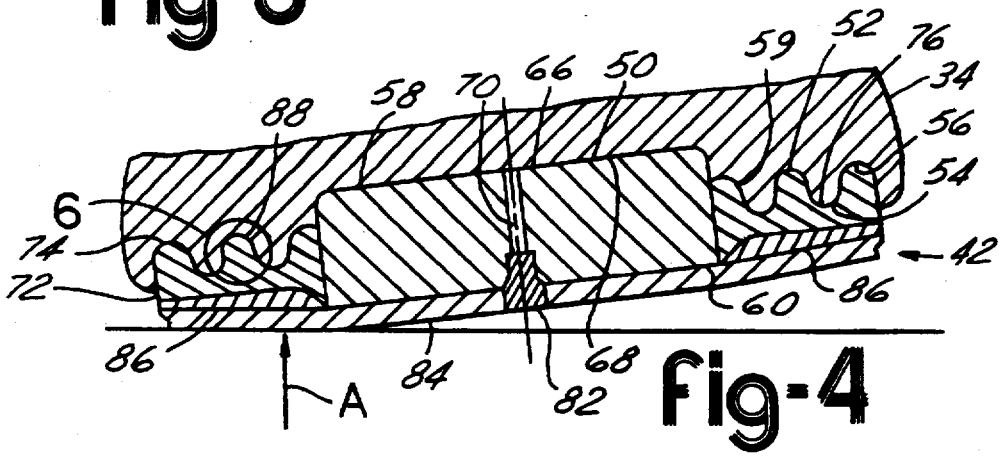
FIG. 4 is a view similar to FIG. 3 showing a deformed condition due to an applied force.

On the other hand, when the wearer subjects the rotating cleat assembly 42 to a force other than one that is substantially normal to the playing surface, like force B as shown in FIG. 4, then the braking member 72 will deform and, as a result, the protrusions will contact and mate with their corresponding recesses. This force B can be created when the wearer is moving forward or sideways while the cleat assembly 42 impacts the playing surface. The force B causes a line contact 88 to occur between the mating surfaces. In these circumstances, the load is not distributed over a large surface but rather over a very narrow or line contact 88 between the two surfaces, which is approximately 0.0005 to 0.001 inches wide along the line of contact. This contact 88 causes the rotating cleat assembly 42 to lock in its current position relative to the sole 34, and will prohibit rotation between the two.

The rotating cleat assembly 42 and sole 34 configuration, then can be customized to affect the triggering of the line pressure at predetermined angles and magnitudes of force. Preferably, in the usual foot plant situation, the cleat assembly 42 is locked, and only in the unusual situation in which the wearer is centered on the foot will the cleat assembly 42 rotate. This is unlike the prior art rotating cleats that are always free to rotate under any conditions.

Figure 7:
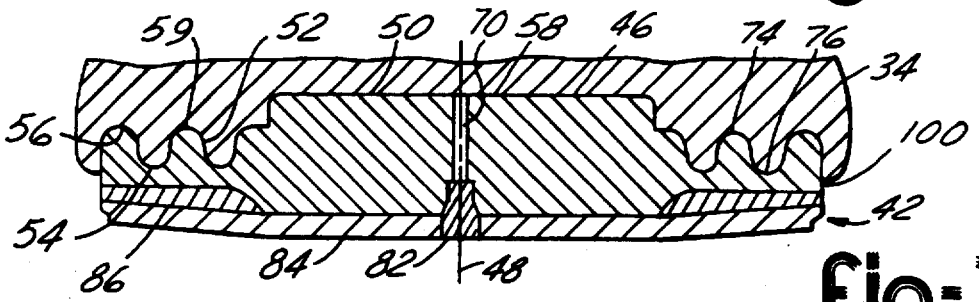
FIG. 7 is a partial cross-sectional view similar to FIG. 3 showing an alternative embodiment of the rotating cleat assembly in accordance with the present invention.

FIG. 7 shows a first alternative embodiment of the present invention having a modified rotating cleat assembly 42. In the alternative embodiments described herein, like numerals represent like elements between the various embodiments. In this embodiment, the bearing member 60 and separate braking member 72 combination of the rotating cleat assembly 42 of the first embodiment are replaced with a single piece main core 100. The overall shape and tolerances of the main core 100 are the same as the combination of the two in the first embodiment and it works in a like fashion. The main core 100 is preferably made of a 70 durometer polyurethane throughout. While this core 100 limits the variation of hardness between the central region of the core and the outer region of the core, it is formed of one piece and consequently needs no bonding process to take place in forming the core 100. Also, the configuration produces a softer rotating combination that enhances the "feel" of the wearer relative to the playing surface.

Figure 8:
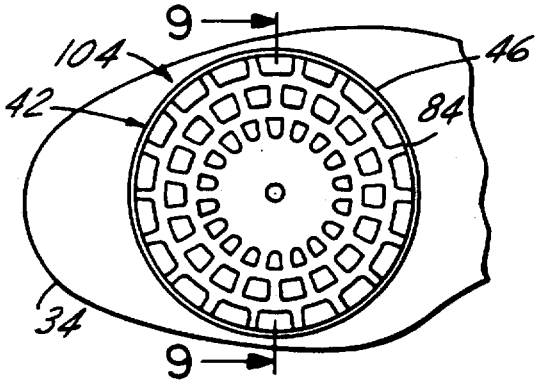
FIG. 8 is a bottom plan view of an alternative embodiment of the present invention.
Figure 9:
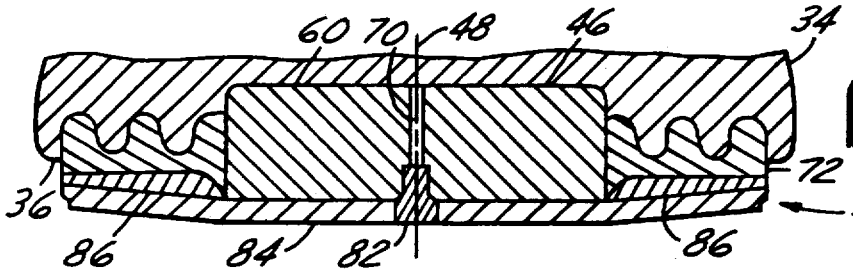
FIG. 9 is a partial cross-sectional view taken along line 9—9 in FIG. 8.
Figure 10:
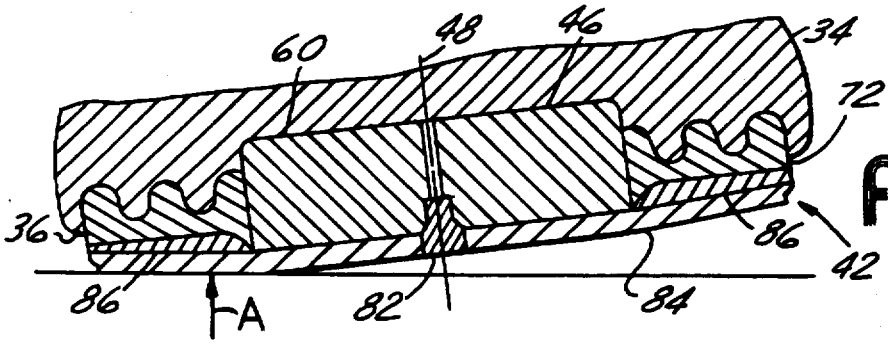
FIG. 10 is a partial cross-sectional view similar to FIG. 9 showing a deformed condition due to an applied force as shown.

FIGS. 8–10 show a second alternative embodiment of the present invention. This embodiment shows a variation on the cleat pattern 104 on the bottom of the rotating cleat assembly 42, the pattern 104 having a series of concentric rectangles. This pattern is typically used more on outdoor grassy playing surfaces and consequently, the ground impact member 84 is made of a hard material such as a polycarbonate. The bearing member 60 and separate braking member 72 are shown in this embodiment, but the one piece core of the second embodiment can also be used.

Figure 11:
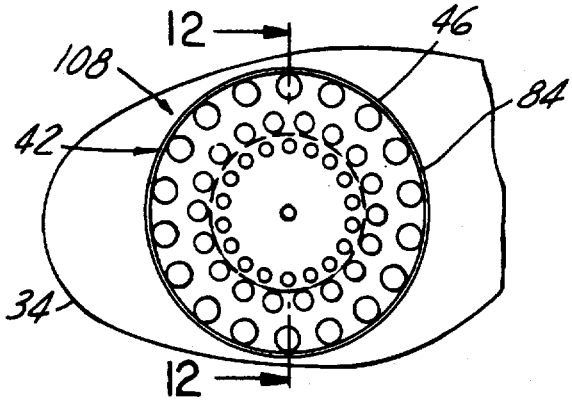
FIG. 11 is a bottom plan view of a further alternative embodiment of the present invention.
Figure 12:
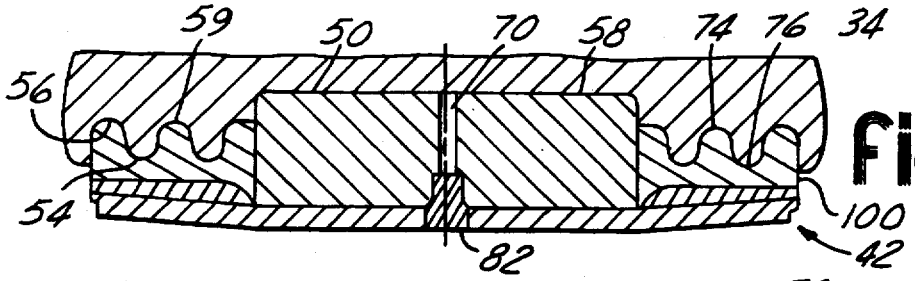
FIG. 12 is a partial cross-sectional view taken along line 12—12 in FIG. 11.
Figure 13:
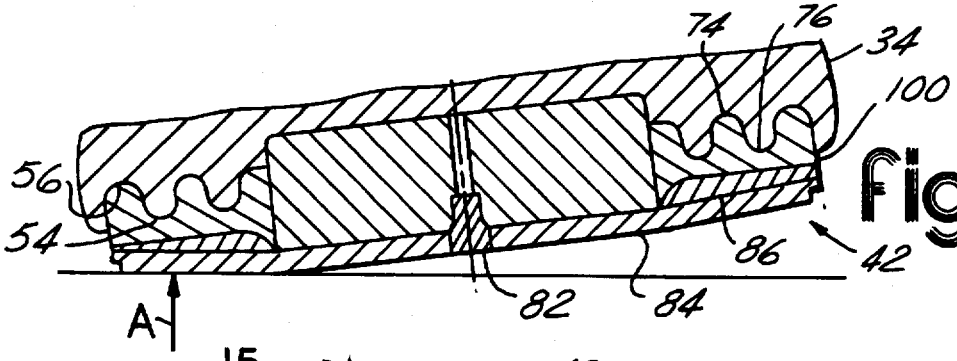
FIG. 13 is a partial cross-sectional view similar to FIG. 12 showing a deformed condition due to an applied force as shown.
Figure 14:
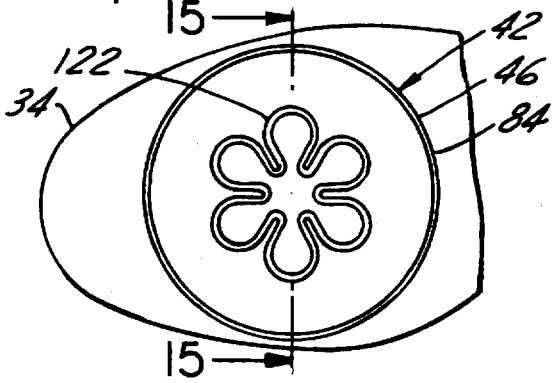
FIG. 14 is a bottom plan view of a further alternative embodiment of the present invention.

FIGS. 11–13 show a third alternative embodiment of the present invention. This embodiment shows yet another cleat pattern 108 that is used on surfaces similar to the second alternative embodiment. In this embodiment, however, the one piece main core 100 is illustrated.

FIGS. 14–17 show a fourth alternative embodiment of the present invention. In these figures, the gap is shown exaggerated for illustration purposes only. This configuration uses a two piece core in the rotating cleat assembly; however, there is an upper core 112 bonded to a lower bearing member 114 rather a central and outer core. The upper bearing member 112 still snaps into place to maintain a similar size gap 58 as in the first embodiment. This bearing member 112 is made of a very high durometer polyurethane in the general range of 70–90 durometer. This embodiment does not include a lubrication bore, but could be modified to include one if so desired. The lower bearing member 114 is made of a medium durometer polyurethane in the general range of 60–80 durometer and has a coating 116 on its bottom side 118 made of a polyurethane having a 50–70 durometer hardness.

Figure 15:
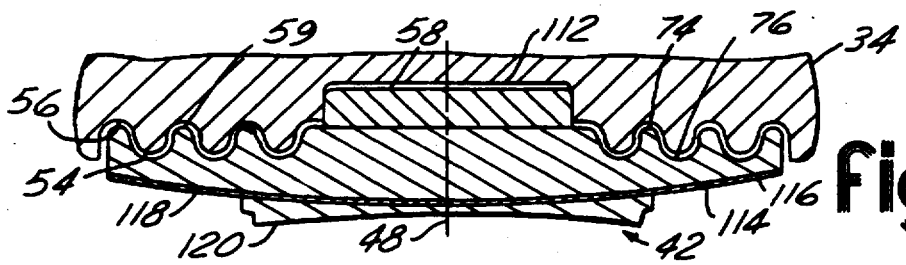
FIG. 15 is a partial cross-sectional view taken along line 15—15 in FIG. 14.
Figure 16:
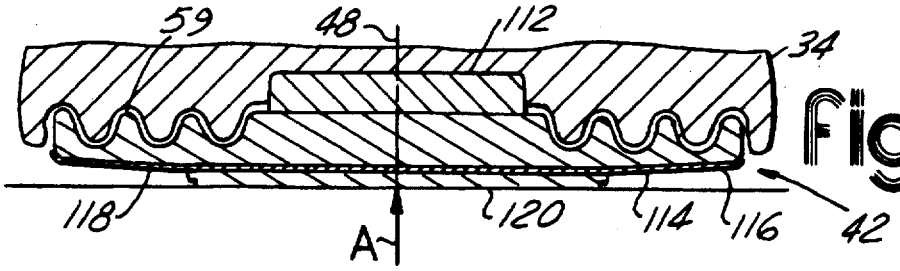
FIG. 16 is a partial cross-sectional view similar to FIG. 15 showing a deformed condition due to an applied force as shown.
Figure 17:
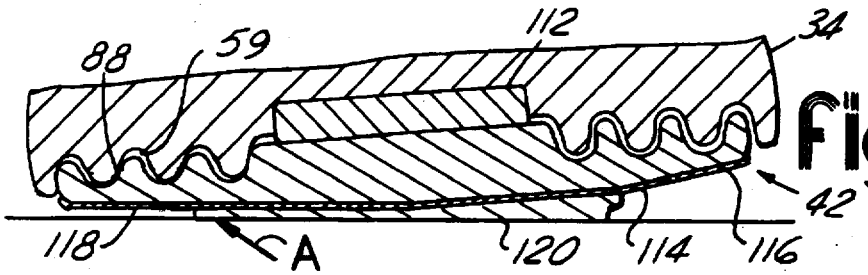
FIG. 17 is a partial cross-sectional view similar to FIG. 15 showing a deformed condition due to an applied force as shown.
Figure 18:
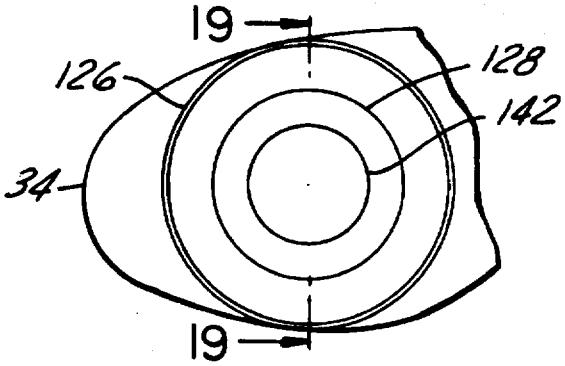
FIG. 18 is a bottom plan view of a further alternative embodiment of the present invention.
Figure 19:
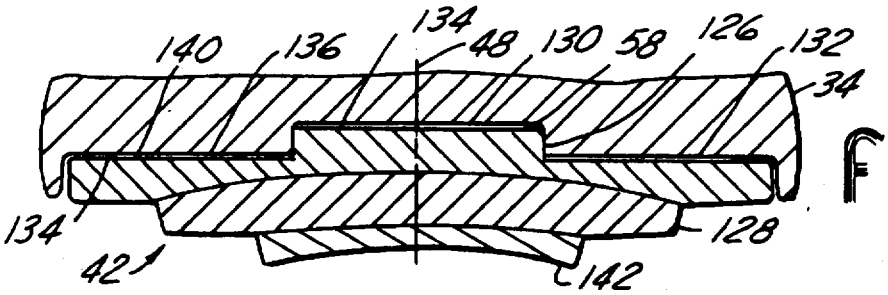
FIG. 19 is a partial cross-sectional view taken along line 19—19 in FIG. 18.

The coating 116 is used because the ground impact member 120, bonded to the coating 116, only extends across approximately one half of the width of the lower core 114. This rosette cleat pattern 122 is used on hard court types of playing surfaces and so the ground impact member 120 is preferably made of a 40–50 durometer polyurethane rather than a harder polycarbonate. FIG. 15 shows the ground impact member 120 having an initial concave curvature on its bottom side that flattens out when a force A is applied to the rotating cleat assembly 42, as shown in FIG. 16.

A fifth alternative embodiment of the present invention is shown in FIGS. 18–21. In this embodiment, the bearing member of the rotating cleat assembly 42 is comprised of an upper core 126 bonded to a lower core 128. The upper core 126 has a central portion 130 and an outer portion 132. The central portion 130 of the upper core 126 again snaps into the central portion 50 of the cavity 46 to provide a gap 58, the same as in the first embodiment. The top surface 134 of the upper core 126 and the bottom surface 136 of the outer portion 138, however, are relatively flat. A gap 140 between the outer portions is still maintained at a minimum of 0.0005 inches to allow selective rotation. The upper core 126 is preferably made of a 70–90 durometer polyurethane.

Figure 20:
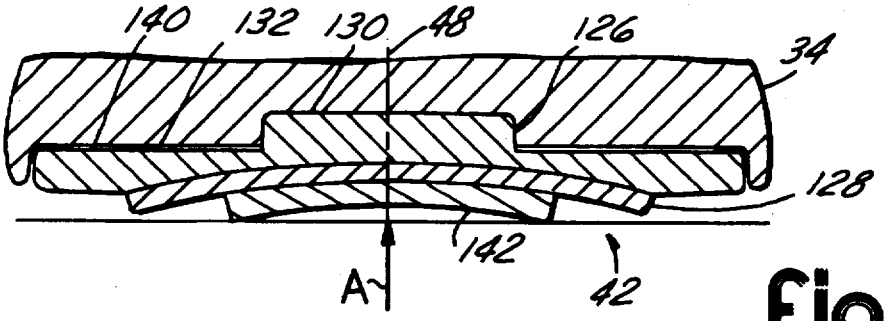
FIG. 20 is a partial cross-sectional view similar to FIG. 19 showing a deformed condition due to an applied force as shown.

The lower core 128 is of a smaller diameter than the upper core 126 and is made of a much softer material, such as a 40 durometer rubber. This core 126, then, will compress relatively easily when a force A is applied normal to the rotating cleat assembly 42, as shown in FIG. 20. The gap 58 will be eliminated, but the upper core 126 will still be able to rotate relative to the cavity 46 because the gap 140 will not be eliminated.

Figure 21:
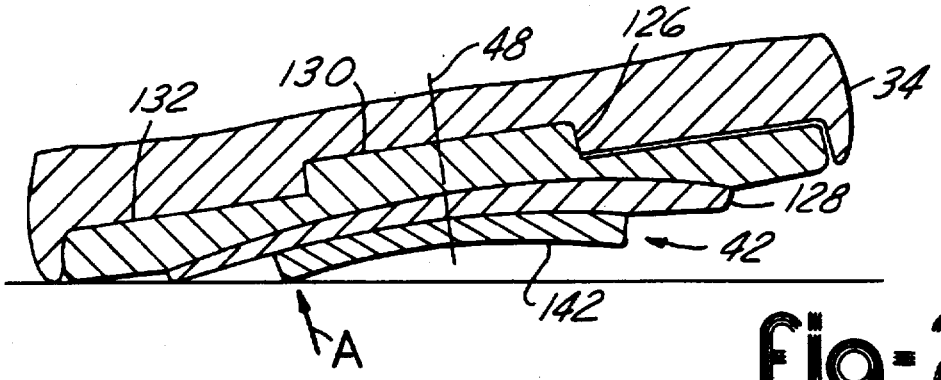
FIG. 21 is a partial cross-sectional view similar to FIG. 19 showing a deformed condition due to an applied force as shown.

Bonded to the bottom of the lower core 128 is circular ground impact member 142. This member is preferably made of a 70–90 durometer polyurethane and is hard enough to hold its general shape even when the force B is applied. When the force A is applied at an angle other than substantially parallel to the central rotational axis 48, the lower core 128 will compress on one side and press against the upper core 126, as shown in FIG. 21. The outer portion 132 of the upper core 126, in turn, presses against the bottom surface 138. This eliminates enough of the gap 140 between the two portions to prevent the two from rotating relative to one another.

Figure 22:
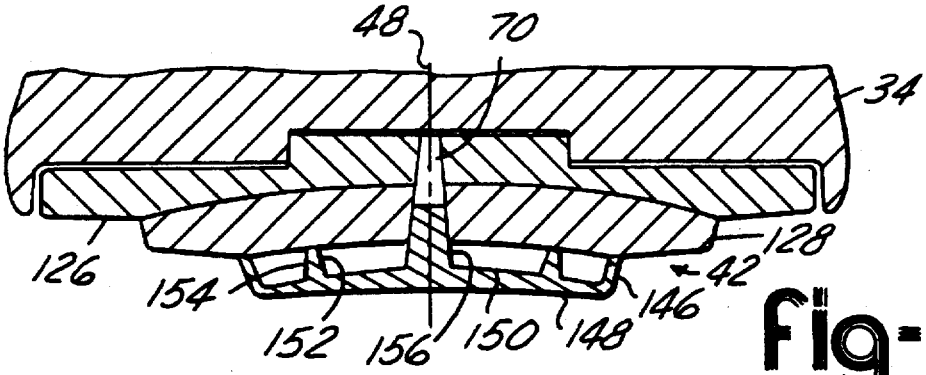
FIG. 22 is a cross-sectional view of a further alternative embodiment of the shoe shown in FIG. 18.

A sixth alternative embodiment of the present invention is shown in FIG. 22. This embodiment employs a removable cap 146. The core configuration of the rotating cleat assembly 42 is shown similar to the fifth alternative embodiment, with the addition of a lubrication bore 70, but other core configurations will also work. In this embodiment, the ground impact member 148 has a two piece design. A first permanent portion 150 is bonded to the lower core 128. A second removable cap 146 fits over and covers the permanent portion 150. The removable cap 146 is held in place by having two or more tapered studs 152 protruding from it that have an interference fit with two support bores 154 through the permanent portion 150. Also, the lubrication plug 156 can be made integral with the removable cap 146 to plug the lubrication bore 70 and to further help hold the removable cap 146 in place.

This configuration allows the wearer to vary the configuration of the ground impacting piece by allowing interchangeability of various caps 146 having various hardness and cleat configurations. Then, the line pressure can trigger more directly or less directly depending on whether the wearer is playing football on an artificial surface, which requires a significant ability to pivot while running, or soccer that requires different pivoting characteristics when constantly planting one foot and then pivoting around it to strike the ball with their other foot. Further, the wearer can control when the locking mechanism is triggered by altering the configuration of the cleat itself when replacing the cap 146.

Figure 23:
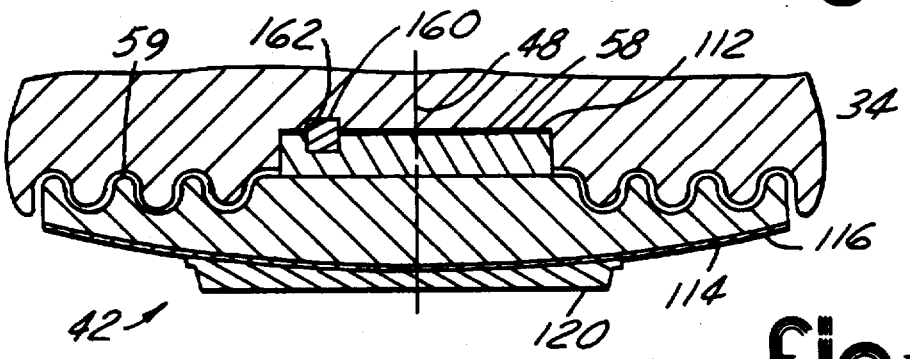
FIG. 23 is a cross-sectional view of a further alternative embodiment of the rotating cleat assembly in accordance with the present invention.

FIG. 23 shows a seventh alternative embodiment of the present invention. The core configuration is shown similar to the fourth embodiment, but the other core configurations can be used. In this embodiment, the recess in the shoe 30 and the upper core each have a corresponding cavity 162 adapted to receive a pin 160. The pin 160 can be inserted into one half of the cavity 162 by the wearer when the rotating cleat assembly 42 is removed from the cavity 46. Then, when the rotating cleat assembly 42 is re-inserted into the cavity 46, with the pin 160 in place, the pin 160 will completely disable the rotation capability between the sole 34 and the rotating cleat assembly 42.

In an additional variation to the embodiments discussed above, the ground impacting surface can have small cleats protruding from the bottom of it like traditional shaped cleats rather than the cleat patterns disclosed above.

While the best mode for carrying out the invention has been described in detail, those familiar with the art to which this invention relates will recognize various alternative designs and embodiments for practicing the invention as defined by the following claims.

It is claimed:

1. A cleated athletic shoe comprising:

a sole having a central recess and at least one outer recess at least partially surrounding said central recess, an upper body attached to said sole, and at least one rotatable cleat assembly attached to said sole, said rotatable cleat assembly comprising a bearing member rotatably mounted about a rotational axis in said central recess and which remains rotatable with respect thereto when subjected to a force applied to said cleat assembly substantially along said rotational axis and a braking member attached to the bearing member and disposed in said at least one outer recess, said braking member being sufficiently deflectable with respect to said at least one outer recess to frictionally mate therewith to selectively prevent rotation of said rotatable cleat assembly relative to said sole during athletic play upon application of a preselected level of force to said cleat assembly not substantially along the rotation axis, wherein a gap is provided between said at least one outer recess and said braking member whereby said braking member remains generally free of said at least one outer recess when a force is applied generally along the rotational axis so as to permit said bearing member to abut and rotatably bear in said central recess, and whereby said braking member, in response to a force not generally along the rotational axis, will deform to sufficiently frictionally engage said at least one outer recess to prevent the cleat assembly from rotating under athletic play.

2. A cleated athletic shoe comprising:

a sole having a central recess and at least one outer recess surrounding said central recess, an upper body attached to said sole, and at least one rotatable cleat assembly attached to said sole, said rotatable cleat assembly comprising a bearing member rotatably mounted about a rotational axis in said central recess and which remains rotatable with respect thereto when subjected to a force applied to said cleat assembly substantially along said rotational axis and a braking member attached to said bearing member and disposed in said outer recess, said braking member being sufficiently deflectable with respect to said outer recess to frictionally mate therewith to prevent rotation of said rotatable cleat assembly relative to said sole upon application of a force to said cleat assembly not substantially along the rotational axis;

said cleat assembly further comprising a bottom member attached to said bearing member and said braking member and further comprising a compliant member positioned at least partially between said bottom member and said braking member, said compliant member being made from a compressible material softer than said braking member and softer than said bottom member.

3. A cleated athletic shoe comprising:

a sole having a central recess aligned about a rotational axis and at least one outer recess at least partially surrounding said central recess;

an upper body attached to the sole; and at least one rotatable cleat assembly attached to said sole;

said rotatable cleat assembly rotatably mounted within the central recess and comprising a bearing member and a braking member attached to the bearing member;

the bearing member being generally freely rotatably about the rotational axis in said central recess;

the braking member being generally freely rotatable about the rotational axis when rotating in a plane substantially perpendicular to the rotational axis in response to a resultant force applied to the rotatable cleat assembly substantially along the rotational axis; and the braking member being frictionally prevented from rotating when deformed out of a plane substantially perpendicular to the rotational axis, in response to a resultant force applied to the rotatable cleat assembly, under playing conditions, which is not directed substantially along the rotational axis thereby deflecting the braking member into sufficient frictional engagement with the outer recess of the sole to prevent rotational movement of the rotatable cleat assembly relative to the sole.

4. The cleated athletic shoe of claim 3 wherein:

a gap is defined between the braking member and the outer recess when the braking member is disposed generally perpendicular to the rotational axis; and the rotatable cleat assembly is sufficiently deformable out of a plane generally perpendicular to the rotational axis to overcome the gap with the braking member frictionally engaging the outer recess of the sole to prevent rotation of the rotatable cleat assembly in response to a resultant force of sufficient magnitude applied to the rotatable cleat assembly not along the rotational axis during athletic play.

* * * * *